US005974913A

United States Patent [19]

Von Rotz et al.

[11] Patent Number: 5,974,913

[45] Date of Patent: Nov. 2, 1999

[54] POWERED GATE VALVE WRENCH APPARATUS

[76] Inventors: Darryl A. Von Rotz, 2933 17th St., Sacramento, Calif. 95818; Michael J. Ayers, 808 Cottonwood Dr., Roseville, Calif. 95661

[21] Appl. No.: 09/053,495

[22] Filed: Mar. 31, 1998

[51] Int. Cl.[6] ..... B25B 17/00

[52] U.S. Cl. ..... 81/57.14

[58] Field of Search ..... 81/57.13, 57.14

[56] References Cited

U.S. PATENT DOCUMENTS

| | | | |
|---|---|---|---|
| 1,871,857 | 8/1932 | Martois . | |
| 2,379,878 | 7/1945 | Bronander . | |
| 2,436,650 | 2/1948 | Killmer | 81/57.13 |
| 2,578,279 | 12/1951 | Bardwell . | |
| 2,682,188 | 6/1954 | Ferrell . | |
| 2,825,252 | 3/1958 | Roberts | 81/57.14 |
| 3,308,691 | 3/1967 | Guier . | |
| 4,287,795 | 9/1981 | Curtiss . | |
| 4,376,396 | 3/1983 | Hayhoe . | |
| 5,355,751 | 10/1994 | Specht . | |
| 5,388,647 | 2/1995 | McGlothlin . | |

*Primary Examiner*—David A. Scherbel
*Assistant Examiner*—Philip J. Hoffmann
*Attorney, Agent, or Firm*—John P. O'Banion

[57] ABSTRACT

A powered gate valve wrench having a motor, a belt drive assembly coupled to the motor, a chain drive assembly coupled to the belt drive assembly and an output shaft attached to the chain drive assembly. The output shaft has two splined ends capable of receiving a socket attached thereon, which couples to a gate valve to transmit the rotational force of the motor to the gate valve. When coupled to the gate valve, each end of the shaft provides rotation in opposite directions. The entire assembly is mounted to a lightweight, compact housing for portability.

18 Claims, 7 Drawing Sheets

POWERED GATE VALVE WRENCH APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention pertains generally to power tools, and more particularly to a powered automatic gate valve wrench apparatus for use in rapidly opening and closing a gate valve.

2. Description of the Background Art

In sewage treatment plants, hydroelectric plants, and other facilities where liquids are controlled and moved from location to location, very large gate valves are used to regulate the flow of these liquids. Most of these gate valves are manually operated with a removable hand crank. Due to the high turns ratio of these gate valves, many revolutions are necessary to either open or shut the valves, requiring at least 10 to 15 minutes to either completely open or close each valve. Such manual procedures for both opening and closing gate valves make the task of adjusting fluid flow through the gate valve tedious, time-consuming and physically tiring. Since the number of gate valves can be numerous and located at a considerable distance from each other, providing a dedicated powered means to control each individual valve can be cost prohibitive.

Accordingly, there exists a need for portable powered tool capable of coupling to a gate valve and which provides for the rapid opening and closing of a gate valve. The present invention satisfies these needs, as well as others, and generally overcomes the deficiencies found in the background art.

BRIEF SUMMARY OF THE INVENTION

The invention pertains to a powered gate valve wrench that is portable and easily coupled to a gate valve. The powered wrench provides a high speed rotational force in either a clockwise or counter-clockwise direction, as necessary for opening and closing the gate valve.

By way of example and not limitation, the invention generally comprises a motor, a belt drive assembly, a chain drive assembly and splined output shafts. The motor is coupled to the belt drive assembly for a first speed reduction. The chain drive assembly is coupled to the belt drive assembly and has splined output shafts on each side that allows attachment of a socket thereon, that couples to the shaft on a gate valve. Using the invention, the gate valve can be rapidly opened by attaching the socket to one end of the shaft, depending on the rotational direction required, coupling the socket to the gate valve, and activating the motor. Similarly, the gate valve can be rapidly closed by attaching the socket to the other end of the shaft and coupling the socket to the gate valve. Each of the ends of the shaft rotate in opposite directions when coupled to the gate valve. Use of opposing ends of the shaft eliminates the need for a reversing mechanism or a reversible motor, thus avoiding additional weight and expense.

An object of the invention is to provide a powered gate valve wrench which allows for the rapid opening and closing of a gate valve.

Another object of the invention is to provide a powered gate valve wrench in which switching from opening to closing a gate valve, or vice-versa, merely requires using the opposite side of the wrench.

Another object of the invention is to provide a powered gate valve wrench that is lightweight and highly portable.

Another object of the invention is to provide a powered gate valve wrench capable of generating sufficient torque to loosen a stuck gate valve and tighten a gate valve to specification.

Yet another object of the invention is to provide a powered gate valve wrench having a self-contained power source.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
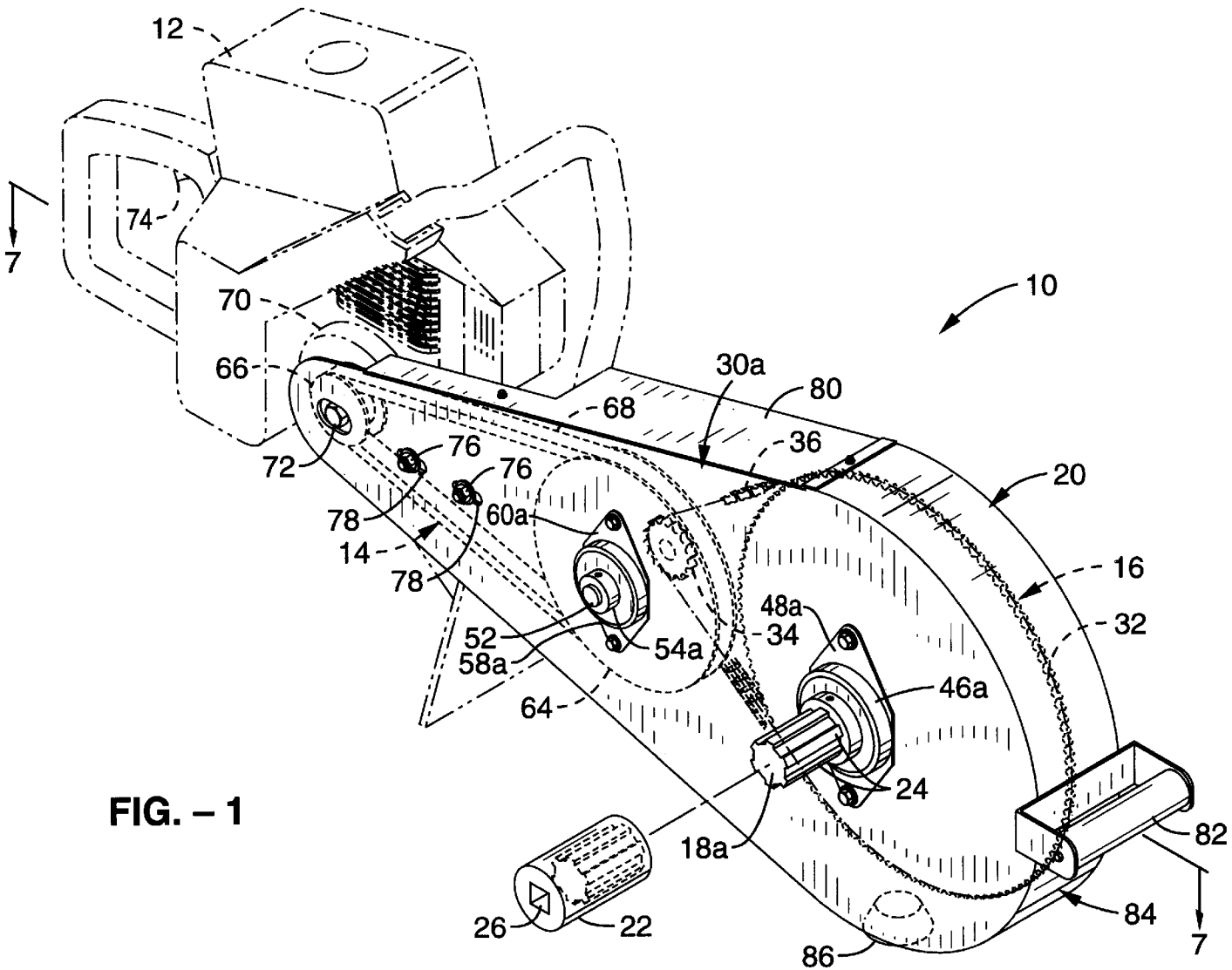
FIG. 1 is a perspective view of the apparatus of the present invention.

Referring more specifically to the drawings, for illustrative purposes the present invention is embodied in the apparatus generally shown in FIG. 1 through FIG. 7, where like reference numbers denote like parts. It will be appreciated that the apparatus may vary as to configuration and as to details of the parts without departing from the basic concepts as disclosed herein.

Referring to FIG. 1 through FIG. 7, an automatic powered gate valve wrench apparatus 10 in accordance with the present invention is generally shown. Apparatus 10 generally comprises a motor 12, a belt drive assembly 14, a chain drive assembly 16, splined output shafts 18*a*, 18*b*, a drive assembly housing 20 and a removable socket 22.

Output shafts 18*a*, 18*b* have splines 24 thereon which engage within notches (not shown) in socket 22 to transmit a rotational force from output shafts 18*a*, 18*b* to socket 22. Socket 22 has an opening 26, such as a ¾" or 1" square, structured and configured to engage the shaft of a gate valve (not shown) to either tighten or loosen the gate valve. Output shafts 18*a*, 18*b* comprise the ends of a single longitudinal member 28 (FIG. 7) that extends through the right side 30*a* and left side 30*b* of drive assembly housing 20. Longitudinal member 28, which has splines 24 and typical dimensions of 1"D×6 splined hex×7¾" long, rotates only in a single direction when motor 12 is driving said longitudinal member 28. Output shaft 18*a* rotates clockwise when viewed from right side 30*a* of housing 20 and is therefore used to loosen the gate valve. Conversely, output shaft 18*b* rotates counterclockwise when viewed from left side 30*b* of housing 20 and is therefore used to tighten the gate valve. The use of a single longitudinal member 28 to form output shafts 18*a*, 18*a* eliminates the need for complicated and expensive gearing mechanisms.

Figure 2:
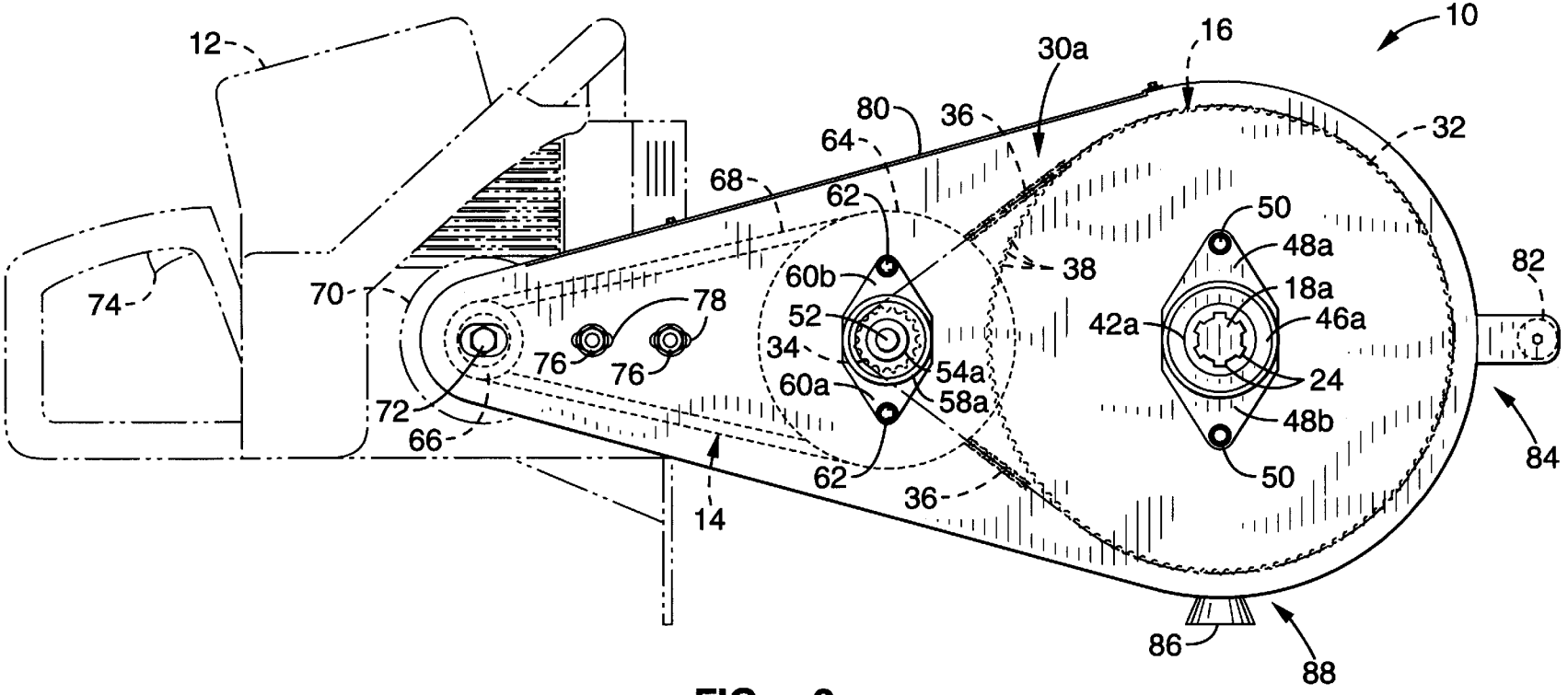
FIG. 2 is side elevation view of the apparatus shown in FIG. 1 viewed from the right.
Figure 3:
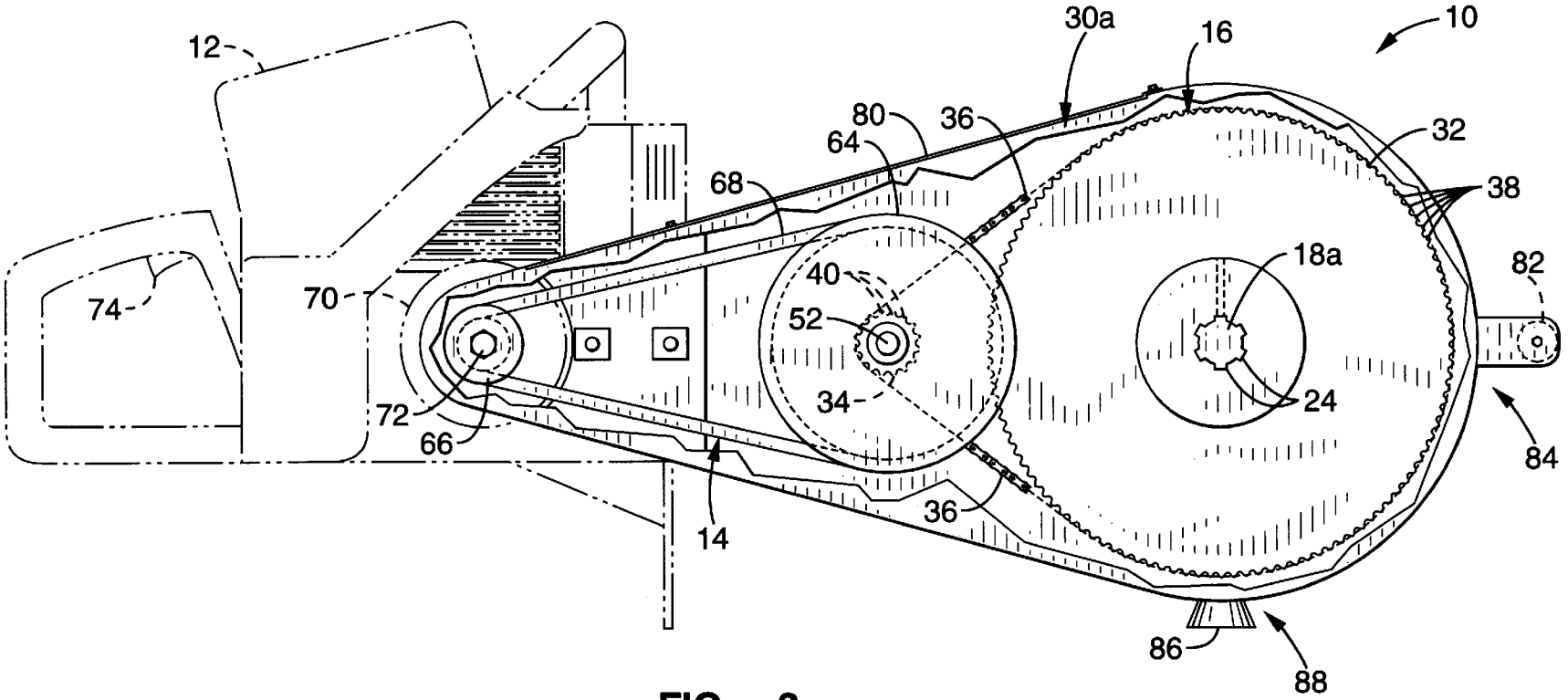
FIG. 3 is a cutaway view of the apparatus shown in FIG. 2.
Figure 4:
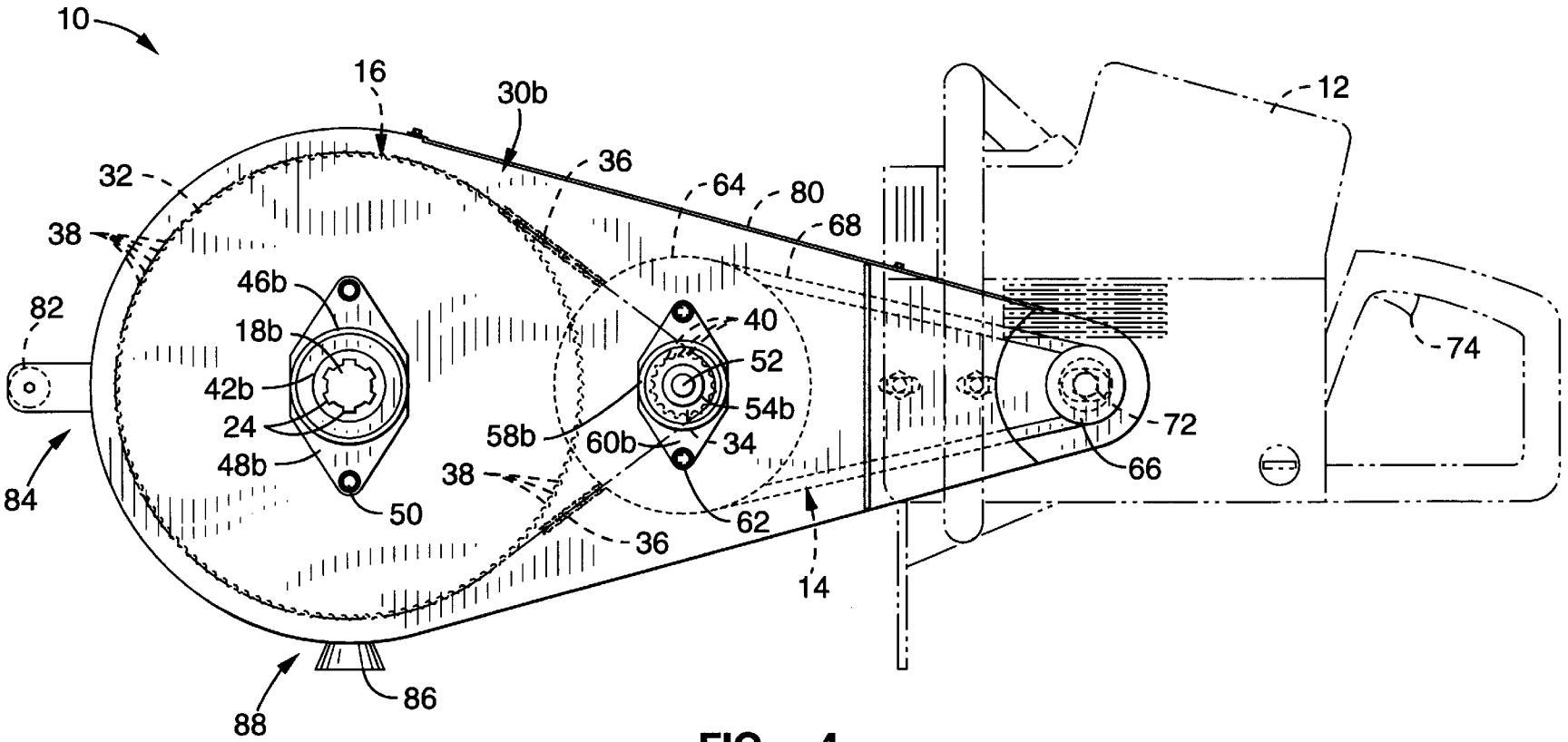
FIG. 4 is side elevation view of the apparatus shown in FIG. 1 viewed from the left.
Figure 5:
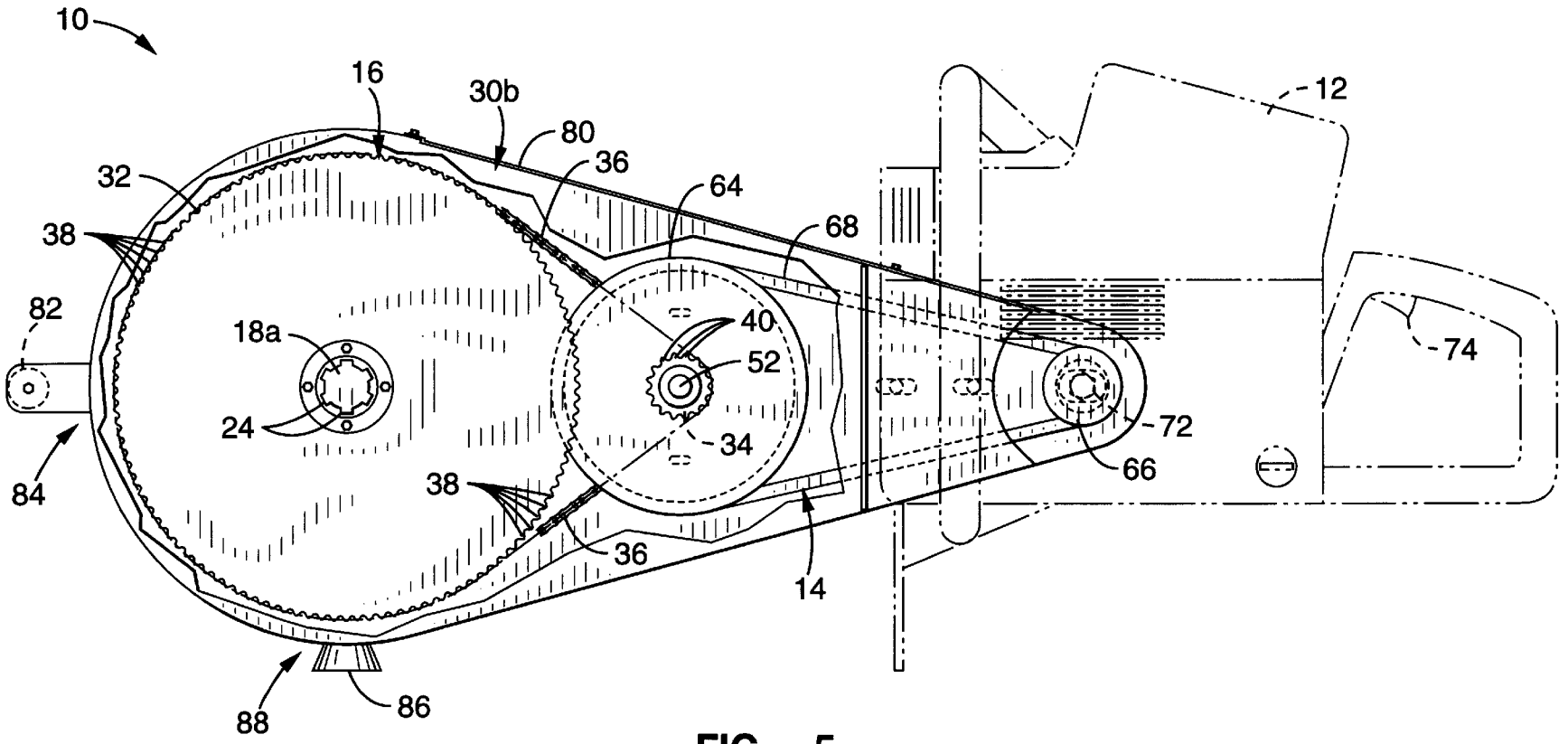
FIG. 5 is a cutaway view of the apparatus shown in FIG. 4.
Figure 6:
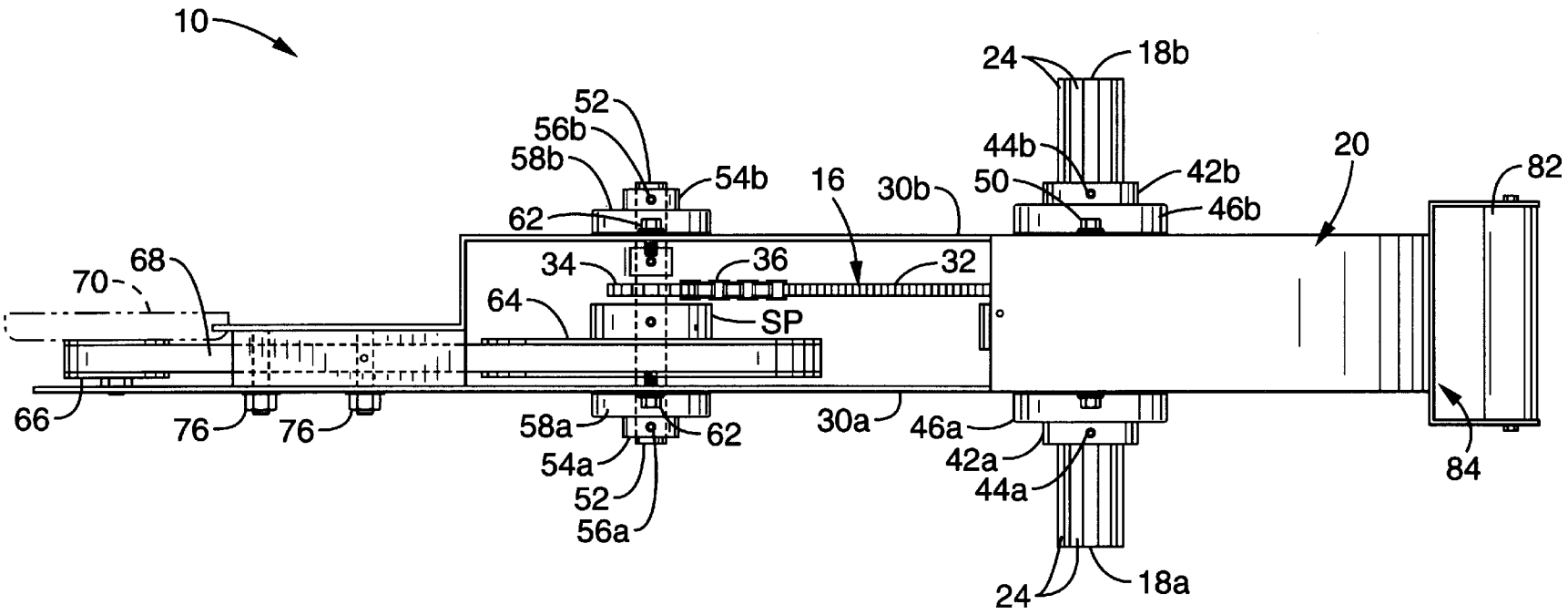
FIG. 6 is top plan view of a drive mechanism of the apparatus shown in FIG. 1.
Figure 7:
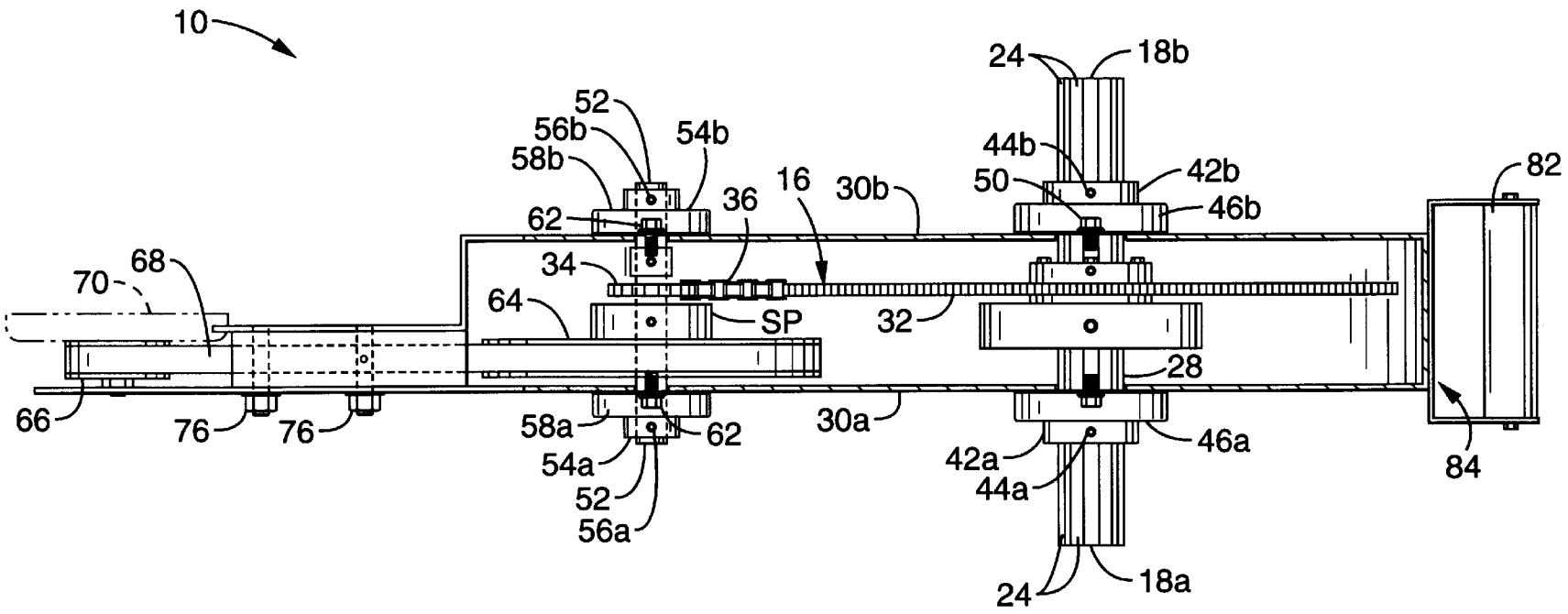
FIG. 7 is a cutaway view of the drive mechanism shown in FIG. 6.

As can be seen in FIG. 2, FIG. 4 and FIG. 6, the rotational force of output shafts 18*a*, 18*b* is derived from chain drive assembly 16, which comprises a large sprocket wheel 32, a small sprocket wheel 34 and a sprocket chain 36. Longitudinal member 28 is disposed axially through large sprocket wheel 32, therefore a rotation of large sprocket wheel 32 causes a corresponding rotation of longitudinal member 28 and thus output shafts 18*a*, 18*b*. Rotation of small sprocket wheel 34 is transmitted to large sprocket wheel 32 through sprocket chain 36 (e.g., #35×30⅜" length or the like). Large sprocket wheel 32 typically has a total of seventy-two teeth 38 (e.g., #35×72T with a 1"×6 splined hub or the like), while small sprocket wheel 34 typically has a total of eleven teeth 40 (e.g., #35×11T×⅝" bore with 3/16" keyway or the like), resulting in a speed reduction of approximately 6.55:1. Collars 42*a*, 42*b*, which limit axial movement of longitudinal member 28, slide onto longitudinal member 28 and are held in place by set screws 44*a*, 44*b*, respectively. The smooth rotation of longitudinal member 28 is accomplished through use of bearings 46*a*, 46*b* (e.g., NICE N6916×1" shaftsize, sealed type, or the like) mounted on flanges 48*a*, 48*b*, respectively and attached to right side 30*a* and left side 30*b*, respectively of housing 20 by bolts 50. A cross-shaft 52 is axially disposed through small sprocket wheel 34. The specifications for cross-shaft 52 are typically 4⅝"L×⅝"D with a 2"×3/16" keyway or the like. Collars 54*a*, 54*b* limit axial movement of cross-shaft 52 and are held in place by set screws 56*a*, 56*b*, respectively. The smooth rotation of cross-shaft 52 is accomplished also through use of bearings 58*a*, 58*b* (e.g., NICE N6910×⅝" shaftsize, sealed type, or the like) mounted on flanges 60*a*, 60*b*, respectively. Flanges 60*a*, 60*b* are attached to right side 30*a* and left side 30*b*, respectively of housing 20 by bolts 62.

Cross-shaft 52 is also axially disposed through a large sheave 64. Large sheave 64 is separated from small sprocket wheel 34 by a spacer SP. Large sheave 64 is typically a Browning OK50×⅝" (e.g., 5"CD×8 mm W×⅝" bore with 3/16" keyway or the like). Large sheave 64 is driven by small sheave 66 through belt 68. Small sheave 66 is coupled to a clutch 70 by a bolt 72. Small sheave 66 typically has dimensions of 2"D×8 mm W or the like, and belt 68 is typically a 8 mm×670 mm V-belt or the like. Large sheave 64, small sheave 66, belt 68 and clutch 70 make up the components of belt drive assembly 14. Belt drive assembly 14 preferably has a speed reduction from small sheave 66 to large sheave 64 of approximately 2.5:1. The combination of belt drive assembly 14 and chain drive assembly 16 results in a total speed reduction of approximately 16.38:1 from motor 12 to output shafts 18*a*, 18*b*. Those skilled in the art will appreciate that belt drive assembly 14 and chain drive assembly 16 could employ belts, chains or any other combination of bands to couple the drive assemblies without departing from the scope of the invention.

Clutch 70 is a conventional clutch that can be coupled to a motor 12, such as a gas powered engine as shown, as is commonly used with chain saws or similar equipment. Motor 12 typically has an operating speed between approximately 2800 RPM and 10,000 RPM, representing the speed range from idle to maximum for motor 12. Clutch 70 typically engages at approximately 3500 RPM which results in approximately 214 RPM at output shafts 18*a*, 18*b*. At the maximum motor speed of 10,000 RPM, output shafts 18*a*, 18*b* have a speed of approximately 610 RPM. Thus, the speed at output shafts 18*a*, 18*b*, has an operating band between approximately 214 to 610 RPM. Output of motor 12 is controllable by a throttle 74.

Housing 20 contains belt drive assembly 14 and chain drive assembly 16, and is adjustable to allow for proper tension of chain 36 and belt 68. A pair of bolts 76 secures housing 20 to motor 12 through horizontally elongated slots 78 in housing 20. Tightening the tension of chain 36 and belt 68 requires bolt 72 and bolts 76 to be loosened, housing 20 to be pulled away from motor 12 until the desired amount of tension is achieved, and re-tightening bolt 72 and bolts 76. Housing 20 also includes an inspection plate 80 (FIG. 1) which provides access to chain drive assembly 16 and belt drive assembly 14. Housing 20 and inspection plate 80 are typically fabricated from either twelve gage steel or ⅛" aluminum. To facilitate use of apparatus 10 in any position or orientation, an auxiliary handle 82 is placed at the distal end 84 of housing 20 and a foot 86, preferably fabricated from rubber or like durable material, is located at the bottom 88 of housing 20.

Accordingly, it will be seen that this invention provides for a compact, easily operated apparatus which facilitates the automatic opening and shutting of gate valves, as well as application of rotary motion to other devices requiring such motion for operation. It will also be appreciated that the invention could be used as a powered wrench for installation and/or removal of nuts, bolts, and the like. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A powered wrench apparatus, comprising:

(a) a motor;

(b) a first band drive assembly, said first band drive assembly coupled to said motor;

(c) a second band drive assembly, said second band drive assembly rotationally coupled to said first band drive assembly; and (d) an output shaft rotationally coupled to said second band drive assembly, said output shaft capable of transmitting a rotational force originating from said motor, said output shaft having a first end configured applying rotational force in a first direction when viewed from said first end, said output shaft having a second end configured for applying rotational force in a second direction opposite to said first direction when viewed from said second end.

2. An apparatus as recited in claim 1, wherein said motor comprises a gasoline-powered engine.

3. A powered wrench apparatus, comprising:

(a) a motor;

(b) belt drive means for driving a belt, said belt drive means coupled to said motor;

(c) chain drive means for driving a chain, said chain drive means driven by said belt drive means; and (d) an output shaft coupled to said chain drive means, said output shaft capable of transmitting a rotational force originating from said motor, said output shaft having a first end configured applying rotational force in a first direction, said output shaft having a second end configured for applying rotational force in a second direction opposite to said first direction.

4. An apparatus as recited in claim 3, wherein said motor comprises a gasoline-powered engine.

5. An apparatus as provided in claim 3, wherein said belt drive means is coupled to said motor by a clutch assembly.

6. An apparatus as recited in claim 3, wherein said belt drive means comprises:

(a) a small sheave;

(b) a large sheave; and (c) a belt coupling said small sheave to said large sheave such that said large sheave is driven by said small sheave.

7. An apparatus as recited in claim 3, wherein said chain drive means comprises:

(a) a small sprocket;

(b) a large sprocket; and (c) a chain connecting said small sprocket to said large sprocket such that said large sprocket is driven by said small sprocket.

8. An apparatus as recited in claim 7, wherein said output shaft comprises a longitudinal member disposed axially through said large sprocket thereby capable of being driven by said large sprocket, both ends of said longitudinal member including a plurality of splines structured and configured to engage a socket thereon, whereby said rotational force of said output shaft is transmitted onto said socket.

9. An apparatus as recited in claim 3, further comprising a housing, said housing enclosing said belt drive means and said chain drive means.

10. An apparatus as recited in claim 3, further comprising a means for adjusting said belt drive assembly and said chain drive assembly.

11. An apparatus as recited in claim 3, further comprising a means to vary output speed of said motor.

12. A powered wrench apparatus, comprising:

(a) a motor;

(b) belt drive means for driving a belt;

(c) a clutch which couples said belt drive means to said motor;

(d) chain drive means for driving a chain, said chain drive means driven by said belt drive means; and (e) an output shaft coupled to said chain drive means, said output shaft comprising a longitudinal member, wherein both ends of said longitudinal member include a plurality of splines structured and configured to engage a socket thereon, wherein said output shaft has a first end capable of transmitting a rotational force originating from said motor to a socket in a first direction, and wherein said output shaft has a second end capable of transmitting a rotational force originating from said motor to a socket in a second direction opposite to said first direction.

13. An apparatus as recited in claim 12, wherein said motor comprises a gasoline-powered engine.

14. An apparatus as recited in claim 12, wherein said belt drive means comprises:

(a) a small sheave;

(b) a large sheave; and (c) a belt coupling said small sheave to said large sheave such that said large sheave is driven by said small sheave.

15. An apparatus as recited in claim 12, wherein said chain drive means comprises:

(a) a small sprocket;

(b) a large sprocket; and (c) a chain connecting said small sprocket to said large sprocket such that said large sprocket is driven by said small sprocket.

16. An apparatus as recited in claim 12, further comprising a housing, said housing enclosing said belt drive means and said chain drive means.

17. An apparatus as recited in claim 12, further comprising a means for adjusting said belt drive assembly and said chain drive assembly.

18. An apparatus as recited in claim 12, further comprising a means to vary output of said motor.

* * * * *